US008921676B2

(12) United States Patent
Iwase

(10) Patent No.: US 8,921,676 B2
(45) Date of Patent: Dec. 30, 2014

(54) KEY FOR KEYBOARD INSTRUMENT

(71) Applicant: Kabushiki Kaisha Kawai Gakki Seisakusho, Hamamatsu-shi, Shizuoka-ken (JP)

(72) Inventor: Masahiko Iwase, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 14/215,380

(22) Filed: Mar. 17, 2014

(65) Prior Publication Data

US 2014/0290464 A1 Oct. 2, 2014

(30) Foreign Application Priority Data

Mar. 28, 2013 (JP) ..... 2013-068128

(51) Int. Cl.
*G10C 3/12* (2006.01)

(52) U.S. Cl.
USPC ..... 84/433

(58) Field of Classification Search
USPC ..... 84/423 R, 433–441
See application file for complete search history.

(56) References Cited

U.S. PATENT DOCUMENTS 7,186,907 B2 * 3/2007 Inouye ..... 84/236
7,741,553 B2 * 6/2010 Nishida ..... 84/433

FOREIGN PATENT DOCUMENTS

JP 2009-109601 5/2009

* cited by examiner

*Primary Examiner* — Kimberly Lockett
(74) *Attorney, Agent, or Firm* — Christie, Parker & Hale, LLP

(57) ABSTRACT

A key for a keyboard instrument, which makes it possible to easily attach a weight to a synthetic resin-made key body while securing a desired touch weight to be given during key depression, and can be manufactured at low costs. The key includes a pivotally movable key body made of a synthetic resin, extending in a front-rear direction, and having a recess open downward, and a weight made of a material whose main component has an elasticity, and attached to the key body in a state received in the recess. The recess has a locking portion formed at an opening edge portion in a manner projecting therefrom such that the locking portion allows the weight to be received into the recess while being elastically deformed when the weight is attached to the key body, and locks the received weight in a state prevented from falling out.

6 Claims, 3 Drawing Sheets

KEY FOR KEYBOARD INSTRUMENT

CROSS-REFERENCE TO RELATED APPLICATIONS

This application claims priority to and the benefit of Japanese Patent Application No. 2013-068128, filed on Mar. 28, 2013, the disclosure of which is hereby incorporated by reference in its entirety.

BACKGROUND OF THE INVENTION

1. Field of the Invention

The present invention relates to a key for a keyboard instrument, such as an electronic piano, and more particularly to a key for a keyboard instrument, which is made of a synthetic resin and has a weight attached thereto so as to obtain a desired touch weight to be given during key depression.

2. Description of the Related Art

Conventionally, a key described e.g. in Japanese Laid-Open Patent Publication (Kokai) No. 2009-109601 has been known as the above-mentioned type of key for a keyboard instrument. This key for a keyboard instrument comprises a key body made of a synthetic resin which extends in the front-rear direction and has a rear portion thereof pivotally supported, and a weight attached to the key body. The key body is formed such that a transverse cross section perpendicular to the lengthwise direction has a downwardly open U shape, and a block-shaped weight is bonded to the top, and left and right inner surfaces of the key body, by an adhesive. In this keyboard instrument, the weights are configured to weigh differently according to pitch ranges such that keys for lower-pitched tones are heavier and keys for higher-pitched tones are lighter. Further, in Japanese Laid-Open Patent Publication (Kokai) No. 2009-109601, a method is disclosed in which the key is manufactured by integrally forming the key body and the weight by insert molding such that the weight is built in the key body.

According to the above-described key for a keyboard instrument, in the case of attaching weights to respective key bodies by bonding, it is required to apply the adhesive to the respective surfaces of the weights or the inner surfaces of associated key bodies, and then attach the weights to the respective key bodies one by one. In addition, it is required to cure the adhesive so as to firmly bond the weights to the respective key bodies, which takes time to complete weight attachment. On the other hand, in the case where keys each having a weight therein are manufactured by insert molding, a plurality of types of metal molds are required according to differences in shape and size between the weights. More specifically, in a case where weights are made different in shape and size according to the pitch ranges of keys, a plurality of types of metal molds corresponding to the respective pitch ranges of keys are needed even for the same model of keyboard instrument. As described above, in the case where weights are attached to key bodies by bonding or insert molding, the operation takes much time and labor, which causes an increase in manufacturing costs.

SUMMARY OF THE INVENTION

The present invention provides a key for a keyboard instrument, which makes it possible to easily attach a weight to a synthetic resin-made key body while securing a desired touch weight to be given during key depression, and can be manufactured at low costs.

To attain the above object, the present invention provides key for a keyboard instrument, comprising a pivotally movable key body made of a synthetic resin, extending in a front-rear direction, and having a recess open downward, and a weight made of a material whose main component has an elasticity, and attached to the key body in a state received in the recess, wherein the recess has a locking portion formed at an opening edge portion thereof in a manner projecting therefrom such that the locking portion allows the weight to be received into the recess while being elastically deformed when the weight is attached to the key body, and locks the received weight in a state prevented from falling out.

According to this arrangement, the pivotally movable key body made of a synthetic resin has the recess open downward, and the recess has a locking portion formed at the opening edge of the recess in a manner projecting therefrom. Further, the weight to be attached to the key body is formed of a material whose main component has an elasticity. Therefore, the weight can be received into the recess by being elastically deformed. In other words, if the weight were not elastically deformed when the same is fitted into the recess, the locking portion existing at the opening edge portion of the recess would hinder reception of the weight into the recess. Further, once the weight has been received into the recess of the key body, the weight is locked by the locking portion of the opening edge portion of the recess in a state prevented from falling out. As described above, according to the present invention, it is possible to easily attach the elastically deformable weight to the synthetic resin-made key body while securing a desired touch weight to be given during key depression. Furthermore, it is possible to manufacture the key at lower costs than by the conventional method in which a weight is attached to a key body e.g. by bonding or insert molding.

Preferably, the main component of the weight is rubber.

With the configuration of this preferred embodiment, the main component of the weight is rubber, so that when attaching the weight to the key body, it is possible to easily fit the weight into the recess of the key body while elastically deforming the weight.

Preferably, the main component of the weight is a predetermined kind of synthetic resin.

With the configuration of this preferred embodiment, a predetermined kind of elastic synthetic resin is adopted as the main component of the weight, whereby it is possible to obtain the same advantageous effect as provided by the above-described preferred embodiment.

Preferably, the weight contains metal having a higher specific gravity than that of the main component.

With the configuration of this preferred embodiment, the weight contains a metal having a higher specific gravity than that of the main component, so that it is possible to easily adjust the weight of each of weights by adjusting the kind and amount of the metal contained in the weight, even when the weights have the same shape and size.

Preferably, the weight is formed with a cutout for deforming the weight when the weight is received into the recess.

With the configuration of this preferred embodiment, it is possible to elastically deform the weight further more easily by narrowing the cutout formed in the weight, which further facilitate fitting of the weight into the recess of the key body.

Preferably, the weight has weight thereof set according to a pitch range of the key body to which the weight is attached.

With the configuration of this preferred embodiment, the weight of each weight is set according to a pitch range corresponding to a key body associated with the weight, so that it is possible to obtain touch weights closely analogous to those of keys of an acoustic piano e.g. by setting the weights of the respective weights such that weights of keys in a lower-pitch range are heavier and weights of keys in a higher-pitch range are lighter.

The above and other objects, features, and advantages of the present invention will become more apparent from the following detailed description taken in conjunction with the accompanying drawings.

DETAILED DESCRIPTION OF PREFERRED EMBODIMENTS

Figure 1A:
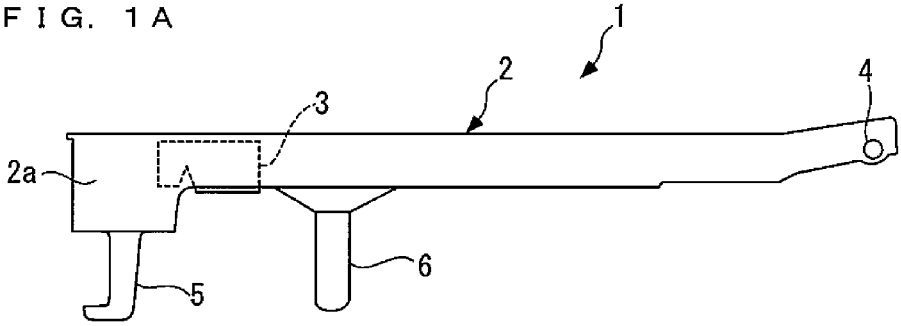
FIG. 1A is a side view of a key for a keyboard instrument, according to an embodiment of the present invention.

The present invention will now be described in detail with reference to the drawings showing a preferred embodiment thereof. FIG. 1A shows a key for a keyboard instrument, according to an embodiment of the present invention. The key 1 is a white key applied to a keyboard e.g. of an electronic piano, and the keyboard is formed by arranging a multiplicity of (e.g. 88) keys 1, together with black keys, not shown, in parallel in the left-right direction (front-rear direction as viewed in FIG. 1A). As shown in FIG. 1A, the key 1 includes a key body 2 extending in the front-rear direction (left-right direction as viewed in FIG. 1A) and a weight 3 attached to the key body 2.

The key body 2 is made of a predetermined kind of synthetic resin (e.g. an AS resin or an ABS resin) and is formed as a molded article having a predetermined shape extending in the front-rear direction. The key body 2 has pivotal projections 4 and 4 (only one of which is shown) projecting in the left-right direction from the rear ends of the respective left and right side surfaces thereof, and the pivotal projections 4 and 4 are pivotally supported by a keyboard chassis (not shown). Therefore, the key 1 is configured to pivotally move about the pivotal projections 4 and 4 in accordance with a key-depressing operation performed by a player. Further, the key body 2 has a pair of stoppers 5 (only one of which is shown) formed at respective front ends of left and right side walls 2*a* and 2*a* thereof, such that each stopper 5 extends downward from the front end of the associated side wall 2*a* by a predetermined length and has a lower end thereof projecting forward, and the lower ends of the respective stoppers 5 come into abutment with an upward movement-limiting portion (not shown) of the keyboard chassis from below, whereby the upper limit position of the key 1 is set. Furthermore, the key body 2 has a hammer pressing part 6 formed at a location slightly forward of a central portion of the key body 2 in the front-rear direction such that the hammer pressing part 6 projects downward by a predetermined length, and the hammer pressing part 6 presses a hammer (not shown) with a key-depressing operation, whereby a touch weight is given by the hammer to the key 1.

Figure 1B:
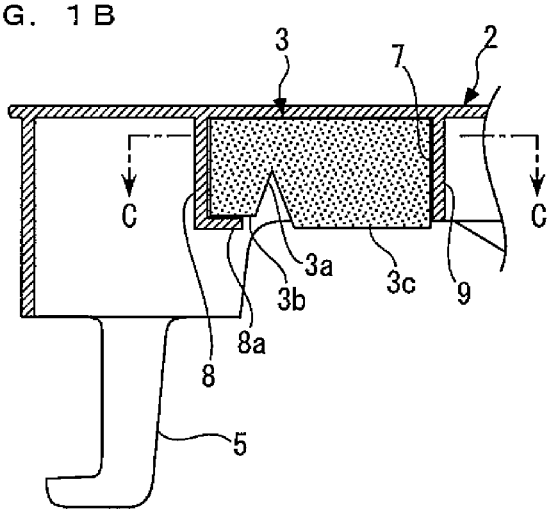
FIG. 1B is an enlarged cross-sectional view of a weight attached to a key body and a portion of the key body around the weight.
Figure 1C:
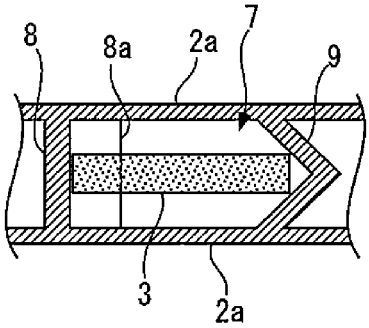
FIG. 1C is a cross-sectional view taken on line C-C of FIG. 1B.

As shown in FIGS. 1B and 1C, the key body 2 has a weight-mounting recess 7 (recess) formed in a front end thereof at a location between the stoppers 5 and the hammer pressing part 6, so as to attach a weight 3 to the key body 2 in a state received in the weight-mounting recess 7. The weight-mounting recess 7 is open downward, and has a front wall 8 and a rear wall 9 extending downward by a predetermined length. The front wall 8 and the rear wall 9 are formed between the left and right side walls 2*a* and 2*a* of the key body 2 in a manner continuous with the side walls 2*a* and 2*a* and spaced from each other with a predetermined distance in the lengthwise direction (i.e. in the front-rear direction). The front wall 8 extends straight between the side walls 2*a* and 2*a* of the key body 2 in a state continued therefrom, whereas the rear wall 9 is formed into a shape tapered rearward in plan view. Further, the front wall 8 has a lower end formed with a locking portion 8*a* for preventing the weight 3 from falling out. The locking portion 8*a* is bent at right angles to the front wall 8 and projects rearward from the lower end of the front wall 8 by a predetermined length.

Figure 2:
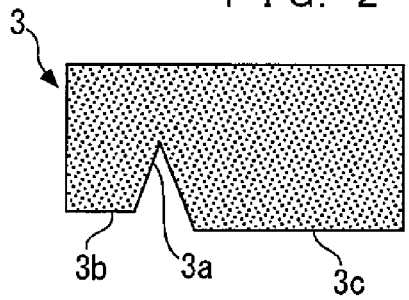
FIG. 2 is a side view of the weight.

The weight 3 is made of a predetermined kind of rubber having a relatively high specific gravity (e.g. chloroprene rubber, butyl rubber, or the like). The weight 3 has substantially the same horizontal and vertical length dimensions as those of the weight-mounting recess 7 and has a predetermined thickness smaller than the lateral width (vertical width as viewed in FIG. 1C) of the weight-mounting recess 7, with a generally horizontally-elongated rectangular shape in side view. More specifically, as shown in FIG. 2, the weight 3 is formed with a wedge-shaped cutout 3*a* open downward and having a depth which is approximately half the height of the weight 3. A portion of the weight 3 extending forward (leftward as viewed in FIG. 2) of the cutout 3*a* (hereinafter referred to as "the weight front portion 3*b*") is configured to be approximately one-fourth of length of the whole weight 3 in the lengthwise direction (left-right direction as viewed in FIG. 2), and the portion of the weight 3 extending rearward (rightward as viewed in FIG. 2) of the cutout 3*a* (hereinafter referred to as "the weight rear portion 3*c*") is configured to be approximately three-fourths of length of the whole weight 3 in the lengthwise direction. Further, the weight 3 is formed such that the height of the weight rear portion 3*c* is larger than that of the weight front portion 3*b*.

Note that the weight 3 is manufactured by die-cutting a relatively large plate-like rubber having the same thickness as that of the weight 3, using a cutting die having the same shape in side view as that of the weight 3.

Figure 3A:
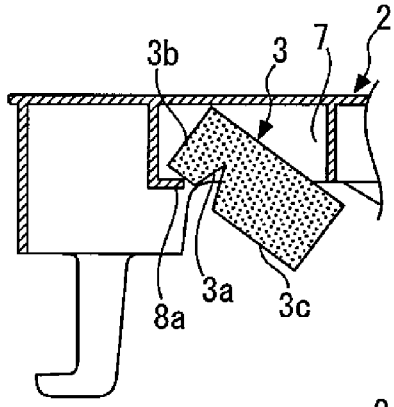
FIGS. 3A to 3C are views useful in explaining a procedure for attaching the weight to the key body.

Now, a brief description will be given, with reference to FIGS. 3A to 3C, of a procedure for fitting the weight 3 into the weight-mounting recess 7 of the key body 2. First, the weight front portion 3*b* is inserted into the weight-mounting recess 7 of the key body 2 from below, as shown in FIG. 3A. In doing this, if the weight 3 were not elastically deformed when the same is fitted into the weight-mounting recess 7, the locking portion 8*a* existing as an opening edge portion would hinder reception of the weight 3 into the weight-mounting recess 7.

Figure 3B:
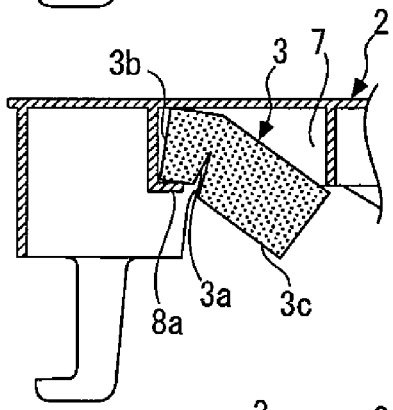
Figure 3C:
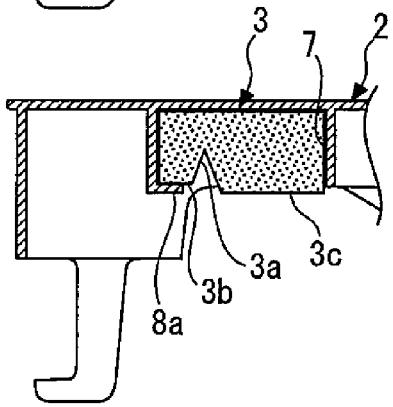

Then, as shown in FIG. 3B, with the weight front portion 3*b* placed on the locking portion 8*a*, the weight 3 is pushed into the weight-mounting recess 7 while being elastically deformed. In this case, the weight 3 is elastically deformed while narrowing the cutout 3*a*, whereby reception of the weight 3 into the weight-mounting recess 7 is allowed. This causes substantially the whole of the weight 3 to be fitted into the weight-mounting recess 7 as shown in FIG. 3C. The weight 3 thus received into the weight-mounting recess 7 is firmly attached to the key body 2, with the front surface, upper surface, and rear surface opposite ends thereof (see FIG. 1C) being supported by the front, upper, and rear surfaces of the weight-mounting recess 7, respectively, and the lower surface of the weight front portion 3*b* being locked by the locking portion 8*a*.

As described above, according to the present embodiment, the weight 3 whose main component is rubber is fitted into the weight-mounting recess 7 of the key body 2 while being elastically deformed, whereby the weight 3 is locked by the locking portion 8*a* as the opening edge portion of the weight-mounting recess 7 in a state prevented from falling out. This makes it possible to easily attach the weight 3 to the key body 2 while securing a desired touch weight to be given during key depression. Further, it is possible to manufacture the key 1 at lower costs than by the conventional method in which a weight is attached to a key body e.g. by bonding or insert molding.

Note that the present invention is by no means limited to the embodiment described above, but it can be practiced in various forms. FIGS. 4A to 4D illustrates variations of the weight 3. A weight 3A shown in FIG. 4A has the same weight front portion 3*b* as that of the weight 3, but the weight rear portion 3*c* thereof is formed to have a height which is approximately half that of the weight 3. Therefore, the weight 3A is lighter than the weight 3, and is configured to be attached to keys 1 in a higher-pitch range than a pitch range corresponding to the key 1 having the weight 3 attached thereto.

Figure 4A:
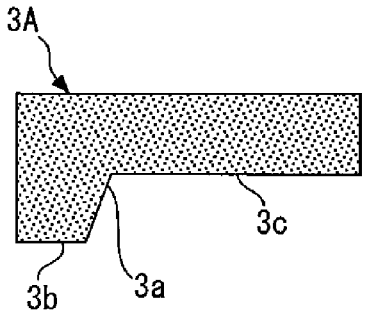
FIGS. 4A to 4D are views of variations of the weight.
Figure 4B:
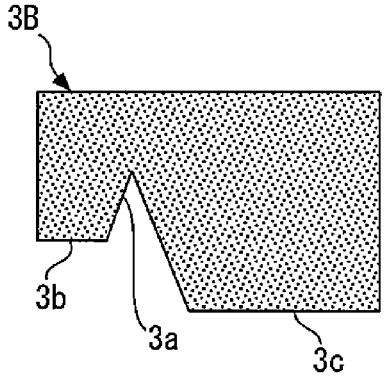

A weight 3B shown in FIG. 4B also has the same weight front portion 3*b* as that of the weight 3, but the weight rear portion 3*c* thereof is formed to have a height which is approximately three-seconds of that of the weight 3. Therefore, the weight 3B is heavier than the weight 3, and is configured to be attached to keys 1 in a lower-pitch range than the pitch range corresponding to the key 1 having the weight 3 attached thereto.

Figure 4C:
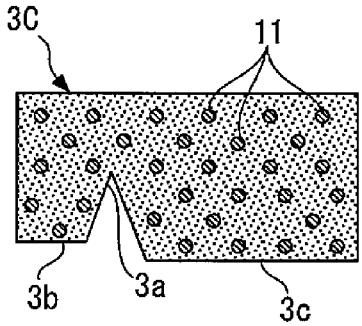
Figure 4D:
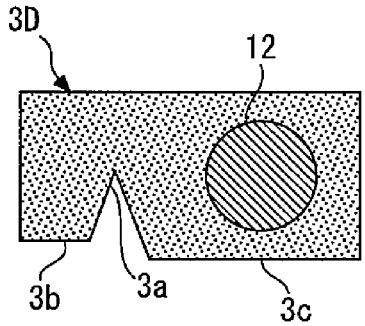

A weight 3C shown in FIG. 4C has the same shape as that of the weight 3, but the weight 3C is formed by adding a predetermined kind of metal particles (e.g. a ferrous material) having a higher specific gravity than that of the rubber, to the rubber which is the main component, in a dispersed manner. Further, a weight 3D shown in FIG. 4D has the weight rear portion 3C provided with a metal cylinder formed of a predetermined kind of metal (e.g. a ferrous material). Therefore, the weights 3C and 3D are heavier than the weight 3, and are each configured to be attached to keys 1 in a lower-pitch range than the pitch range corresponding to the key 1 having the weight 3 attached thereto. The weight of each of the weights 3C and 3D can be adjusted by adjusting the kind and amount of the metal contained therein.

Note that although in the above description, rubber is adopted as the main component of the weight 3 and the weights 3A to 3D as the variations of the weight 3, this is not limitative, but other materials, such as predetermined kinds of synthetic resin and foamed resins (e.g. thermoplastic elastomer, soft polyurethane, urethane foam, etc.), each having an elastic main component contained therein can also be employed.

It is further understood by those skilled in the art that the foregoing is a preferred embodiment of the invention, and that various changes and modifications may be made without departing from the spirit and scope thereof.

What is claimed is:

1. A key for a keyboard instrument, comprising:

a pivotally movable key body made of a synthetic resin, extending in a front-rear direction, and having a recess open downward; and a weight made of a material whose main component has an elasticity, and attached to said key body, said weight being received in said recess, wherein said recess has a locking portion formed at an opening edge portion thereof in a manner projecting therefrom such that said locking portion allows said weight to be received into said recess while being elastically deformed when said weight is attached to said key body, and locks said received weight such that said received weight prevented from falling out.

2. The key according to claim 1, wherein the main component of said weight is rubber.

3. The key according to claim 1, wherein the main component of said weight is a synthetic resin.

4. The key according to claim 1, wherein said weight contains metal having a higher specific gravity than that of the main component.

5. The key according to claim 1, wherein said weight is formed with a cutout for deforming said weight when said weight is received into the recess.

6. The key according to claim 1, wherein said weight has a weight, which is set according to a pitch range of said key body to which said weight is attached.

* * * * *

UNITED STATES PATENT AND TRADEMARK OFFICE

CERTIFICATE OF CORRECTION

PATENT NO. : 8,921,676 B2
APPLICATION NO. : 14/215380
DATED : December 30, 2014
INVENTOR(S) : Masahiko Iwase It is certified that error appears in the above-identified patent and that said Letters Patent is hereby corrected as shown below:

In the Claims

Col. 6, line 30, Claim 1 Delete "weight prevented",
Insert --weight is prevented--

Signed and Sealed this
Fifteenth Day of September, 2015

Michelle K. Lee

Michelle K. Lee
*Director of the United States Patent and Trademark Office*